US012774062B2

(12) United States Patent
Shivalinga et al.

(10) Patent No.: US 12,774,062 B2
(45) Date of Patent: Oct. 27, 2026

(54) INFLATABLE RAFT WITH EXPANDED WELD JOINT

(71) Applicant: Goodrich Corporation, Charlotte, NC (US)

(72) Inventors: Vinod Kumar Shivalinga, Bangalore (IN); Prateek Avaragolla Renukaprasanna, Bangalore (IN); Chana Kesava Reddy, Bengaluru (IN); Ryan Leach, Tempe, AZ (US)

(73) Assignee: GOODRICH CORPORATION, Charlotte, NC (US)

( * ) Notice: Subject to any disclaimer, the term of this patent is extended or adjusted under 35 U.S.C. 154(b) by 306 days.

(21) Appl. No.: 18/737,028

(22) Filed: Jun. 7, 2024

(65) Prior Publication Data

US 2025/0242894 A1 Jul. 31, 2025

(30) Foreign Application Priority Data

Jan. 29, 2024 (IN) ..... 202411005686

(51) Int. Cl.
*B63B 34/52* (2020.01)
*B63B 5/24* (2006.01)
*B63C 9/04* (2006.01)

(52) U.S. Cl.
CPC ..... *B63B 34/52* (2020.02); *B63B 5/24* (2013.01); *B63C 2009/046* (2013.01)

(58) Field of Classification Search
CPC ..... B63C 2009/042; B63C 2009/044; B63C 2009/046; B63C 2009/048; B63C 9/04; B63B 34/52; B63B 5/24; B63B 34/22
See application file for complete search history.

(56) References Cited

U.S. PATENT DOCUMENTS

| | | | | |
|---|---|---|---|---|
| 4,998,900 | A | 3/1991 | Wright | |
| 5,800,225 | A * | 9/1998 | Shoaff, III | B63C 9/02 441/40 |
| 5,921,830 | A | 7/1999 | Shoaff, III | |
| 5,967,869 | A * | 10/1999 | Wiggins | B63C 9/04 441/38 |
| 6,685,520 | B1 * | 2/2004 | Wiggins | B63B 43/12 441/40 |
| 6,749,474 | B2 * | 6/2004 | Hsu | A47C 15/006 441/131 |
| 10,179,998 | B1 * | 1/2019 | Ramp | E04C 3/005 |
| 2019/0308699 | A1 * | 10/2019 | Luzader | B63C 9/04 |
| 2021/0291946 | A1 * | 9/2021 | Reddy | B63B 73/40 |

OTHER PUBLICATIONS

Extended European Search Report for EP Application No. 25154757.6, dated Jul. 14, 2025, pp. 1-9.

* cited by examiner

*Primary Examiner* — Andrew Polay
(74) *Attorney, Agent, or Firm* — CANTOR COLBURN LLP

(57) ABSTRACT

An inflatable raft, having: a base, a sidewall, front and back ends, first and second opposite sides; a first tubular member extending between the sides to define a first arch; and a second tubular member extending from the back end to the first tubular member at a weld joint to define a second arch, at the weld joint the first tubular member has a first diameter, the second tubular member has, end to end, a second diameter that is smaller than the first diameter, and adjacent to the weld joint, the first tubular member has a third diameter that is the same as the second diameter.

15 Claims, 3 Drawing Sheets

INFLATABLE RAFT WITH EXPANDED WELD JOINT

CROSS-REFERENCE TO RELATED APPLICATIONS

This application claims the benefit of Indian Application No. 202411005686 filed Jan. 29, 2024, the disclosure of which is incorporated herein by reference in its entirety.

BACKGROUND

The embodiments are directed to an inflatable raft and more specifically to an inflatable raft with an expanded weld joint.

The RF (radio frequency) welding technology is being used to build rafts eliminates the use of adhesives for joining processes. If joints utilize small diameter connecting surfaces, there may be weaknesses in the connections, resulting in a connection failure at weld joints.

BRIEF SUMMARY

Disclosed is an inflatable raft, including: a base defining a base perimeter and a sidewall extending around the base perimeter, wherein the raft defines a front end, a back end, a first side and a second side that is opposite the first side; a first tubular member extending between the first side and the second side, wherein the first tubular member has a first riser extending from the first side, a second riser extending from the second side and a first runner extending between the first riser and the second riser to define a first arch; and a second tubular member extending from the back end to the first tubular member, wherein the second tubular member has a third riser extending from the back end and a second runner extending to the first runner to define a second arch, wherein, the first runner and the second runner intersect each other at a weld joint, and at the weld joint, the first runner has a first diameter, and the second runner has a second diameter that is smaller than the first diameter, and wherein: a first portion of the first runner extends from the weld joint toward the first riser and a second portion of the first runner extends from the weld joint toward the second riser; and adjacent to the weld joint, the first portion and the second portion of the first runner define a transition from the first diameter to a third diameter that is the same as the second diameter.

In addition to one or more aspects of the raft, or as an alternate, the weld joint is centered along the first runner.

In addition to one or more aspects of the raft, or as an alternate, the raft is fabricated of nylon.

In addition to one or more aspects of the raft, or as an alternate, at the weld joint, the first runner and the second runner are perpendicular to each other.

In addition to one or more aspects of the raft, or as an alternate, the first diameter is at least 125% of a size of the second diameter.

In addition to one or more aspects of the raft, or as an alternate, the first diameter is 6.25 inches and the second diameter is 5 inches.

In addition to one or more aspects of the raft, or as an alternate, at the weld joint, the first runner defines an aperture for air to pass between the first runner and the second runner during inflation of the raft, wherein the aperture defines a fourth diameter that is smaller than the second diameter.

In addition to one or more aspects of the raft, or as an alternate, the second diameter between 150% and 300% of the fourth diameter.

In addition to one or more aspects of the raft, or as an alternate, the fourth diameter is between 2 and 3 inches.

In addition to one or more aspects of the raft, or as an alternate, at the weld joint, the second runner has an end edge that is against or adjacent to the first runner and conforms to a shape of the first runner; a first surface region on the first runner, between the aperture and the end edge of the second runner, defines a first collar seat; a second surface region within the second runner, extending away from the end edge of the second runner, defines a second collar seat; and the raft further includes: a collar having a first collar portion that is welded to the first collar seat and a second collar portion that is welded to the second collar seat, to connect the first runner to the second runner.

In addition to one or more aspects of the raft, or as an alternate, the collar is formed of a same material as the first tubular member and the second tubular member.

In addition to one or more aspects of the raft, or as an alternate, the first collar portion defines a disk shape with a center aperture defining a fifth diameter that is the same as the fourth diameter.

In addition to one or more aspects of the raft, or as an alternate, the second collar portion defines a cylindrical shape having a predetermined length and a sixth diameter that is the same as the second diameter.

In addition to one or more aspects of the raft, or as an alternate, the first collar portion is connected to the first runner by a first RF weld and the second collar portion is connected to the second runner by a second RF weld.

Further disclosed is an inflatable raft, having: a base, a sidewall, front and back ends, first and second opposite sides; a first tubular member extending between the sides to define a first arch; and a second tubular member extending from the back end to the first tubular member at a weld joint to define a second arch, at the weld joint the first tubular member has a first diameter, the second tubular member has, end to end, a second diameter that is smaller than the first diameter, and adjacent to the weld joint, the first tubular member has a third diameter that is the same as the second diameter.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
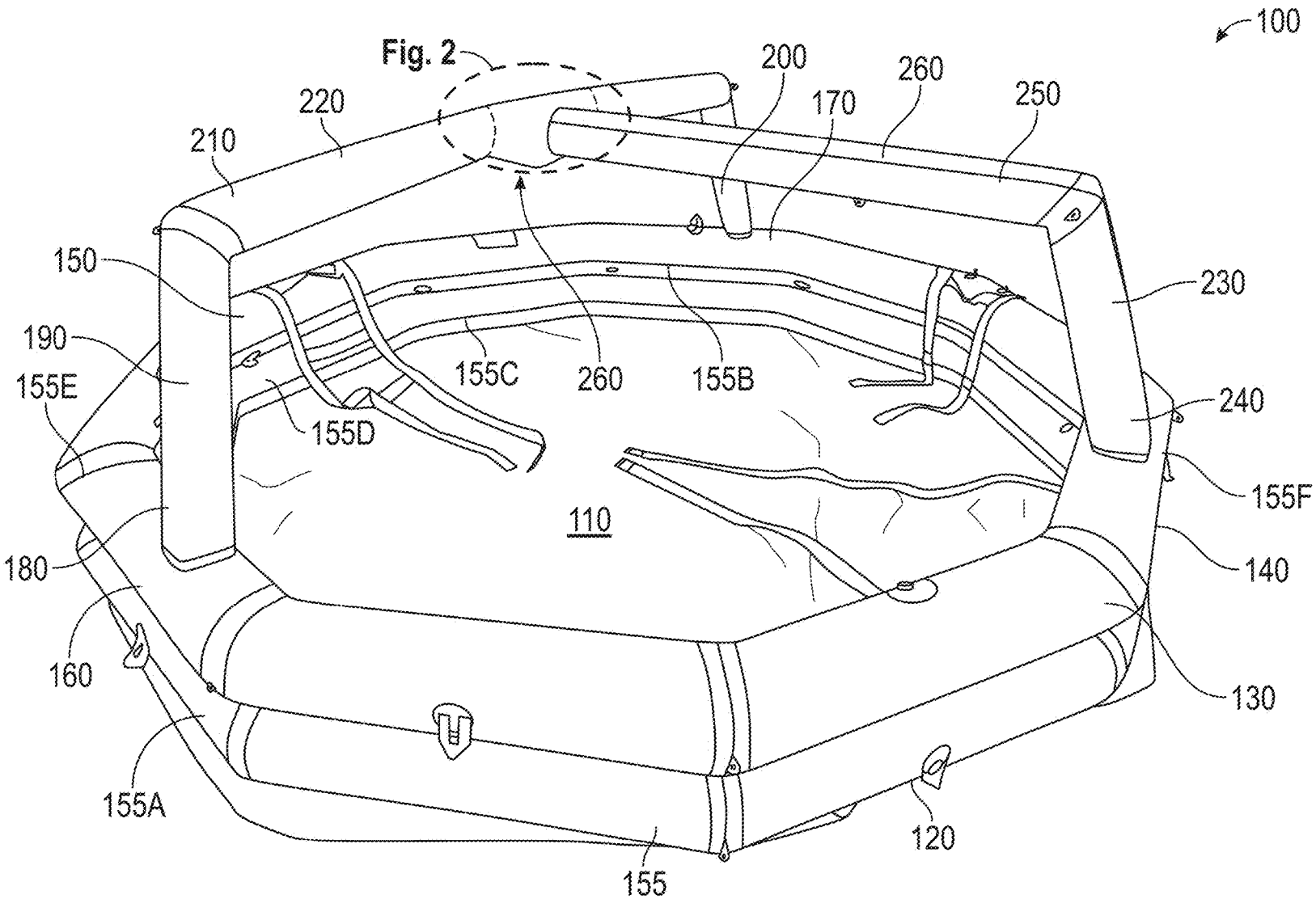
FIG. 1 shows an inflatable raft configured according to an embodiment.

Turning to FIG. 1, an inflatable life raft (for simplicity, a raft 100) is disclosed, which may be fabricated from, e.g., nylon as a nonlimiting example. The raft 100 has a base 110 defining a base perimeter 120 and a sidewall 130 extending around the base perimeter 120. The raft 100 defines a back end 140, a front end 150 that is opposite the back end 140, a first side 160 and a second side 170 that is opposite the first side 160. The illustrated raft 100 is polygonal and more specifically a decagon, though this is not intended on limiting the scope of the embodiments.

A first tubular member 180 extends from the first side 160 and the second side 170. More specifically, the decagonal shape of the raft defines ten segments 155. The first and second sides 160, 170 are on first and second segments 155A, 155B that are spaced apart to define three segments therebetween 155C-155E.

The first tubular member 180 has a first riser (or vertical leg) 190 extending from the first side 160, a second riser 200 extending from the second side and a runner (or horizontal leg) 210 extending between the first and second risers 190, 200 to define a first arch 220.

A second tubular member 230 extends from the back end 140 of the raft 100 to the first tubular member 180. The second tubular member 230 has a third riser 240 extending from the back end 140 and a second runner 250 extending to the first runner 210 to define a second arch 260. A segment 155F to which the third riser 240 is connected is centered between the first and second segments 155A, 155B. The first and second runners 210, 250 intersect each other at a weld joint 260. At the weld joint 260, the first runner 210 and the second runner 250 are perpendicular to each other to form a T-joint.

Figure 2:
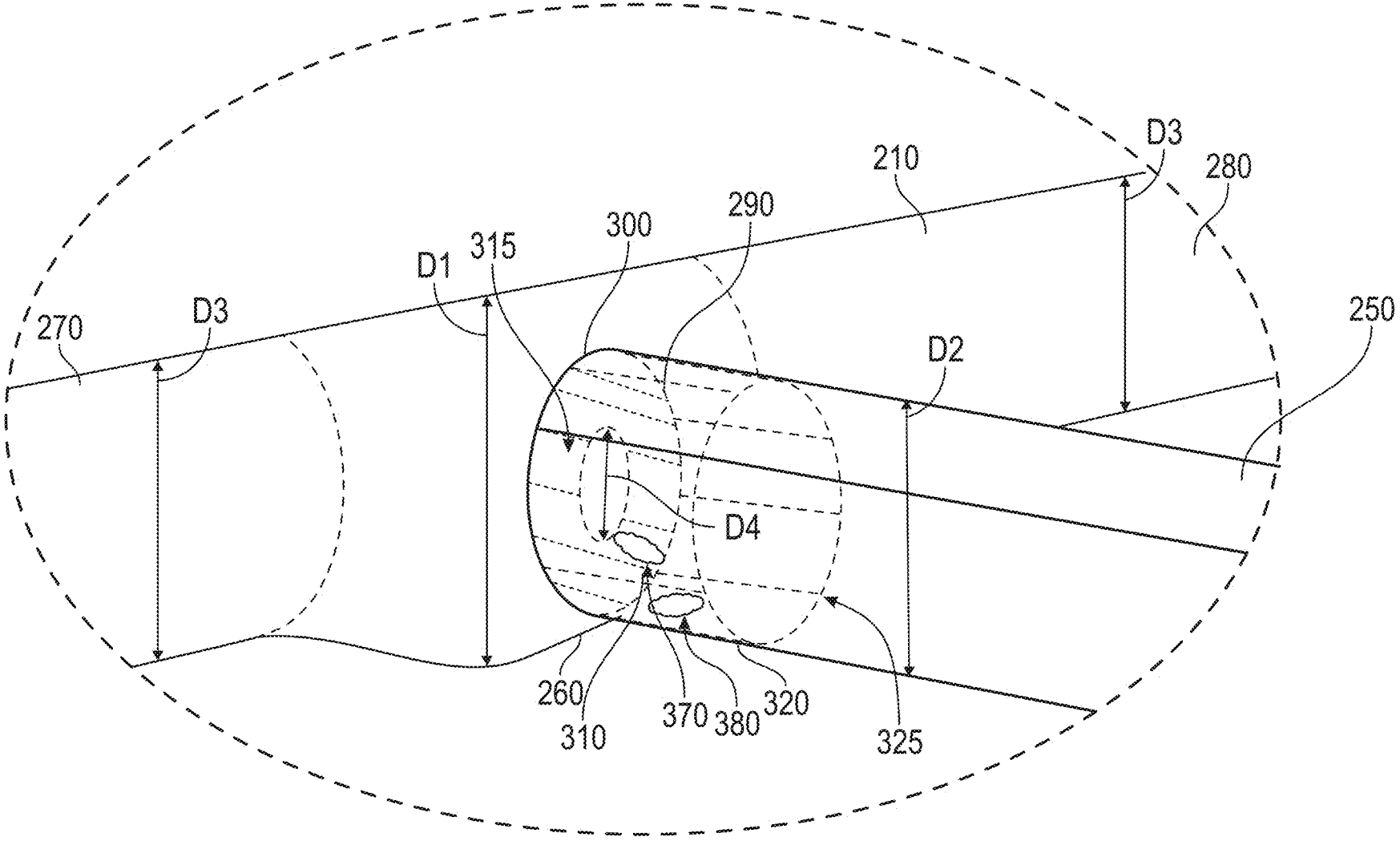
FIG. 2 shows a weld joint of the inflatable raft, where a seating surface on one tubular member has a larger diameter than an end of another tubular member received at the seating surface.

Turning to FIG. 2, at the weld joint 260, the first runner 210 has a first diameter D1 and the second runner 250 has a second diameter D2 that is smaller than the first diameter D1. More specifically, the first diameter D1 is at least 125% of the size of the second diameter D2. For example, the first diameter D1 is approximately 6.25 inches, and the second diameter D2 is approximately 5 inches.

The weld joint 260 is centered along the first runner 210. A first portion 270 of the first runner 210 extends from the weld joint 260 toward the first riser 190 (FIG. 1). A second portion 280 of the first runner 210 extends from the weld joint 260 toward the second riser 200 (FIG. 1). Adjacent to the weld joint 260, the first and second portions 270, 280 of the first runner 210 transition from the first diameter D1 to a third diameter D3 that is the same size as the second diameter D2. That is, the weld joint 260 forms a local protuberant or expanded section at a center of the first runner 210.

At the weld joint 260, the first runner 210 defines an aperture 290 for air to pass between the first and second runners 210, 250 during inflation of the raft 100. The aperture 290 defines a fourth diameter D4 that is smaller than the second diameter D2. For example, the second diameter D2 is between 150% and 300% of the fourth diameter D4. More specifically, the fourth diameter D4 is between 2 and 3 inches.

As shown in FIG. 2, at the weld joint 260, the second runner 250 has an end edge 300. The end edge 300 is against or adjacent to the first runner 210 and conforms to a shape of the first runner 210.

A first surface region 310 on the first runner 210, between the aperture 290 and the end edge 300 of second runner 250, defines a first collar seat 315 or seating surface. The first collar seat 315, due to its larger diameter, is relatively flat compared with a shape of the end edge 300 of the second runner 250. A second surface region 320 within the second runner 250, extending away from the end edge 300 of the second runner 250, defines a second collar seat 325. The second collar seat 325 is substantially cylindrical.

Figure 3:
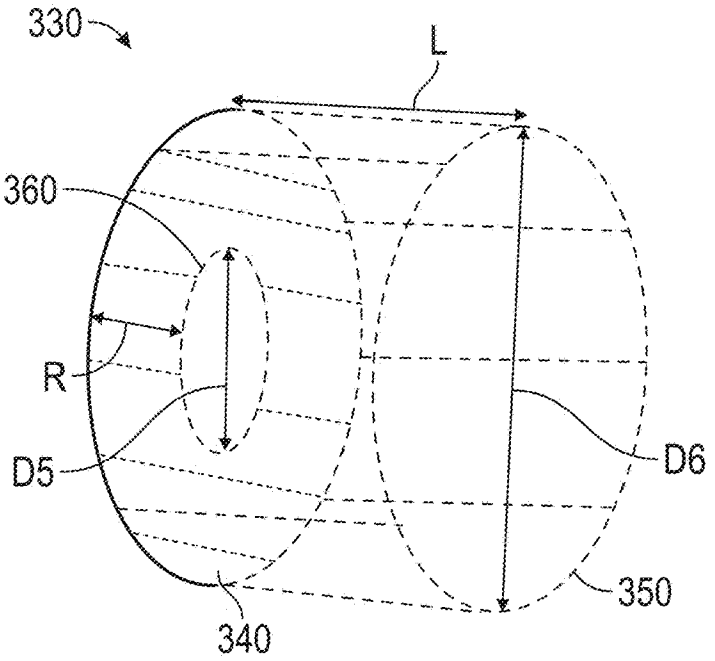
FIG. 3 shows a weld collar utilized to connect the tubular members at the weld joint.

As shown in FIG. 3, the raft 100 further includes a weld collar (or collar) 330 that has a first collar portion 340 that is welded to the first collar seat 315 and a second collar portion 350 that is welded to the second collar seat 325. This configuration connects the first runner 210 to the second runner 250. The collar 330 is formed of a same material as the first and second tubular members 180, 230.

In one embodiment, the first collar portion 340 forms a disk shape defining a center aperture 360 having a fifth diameter D5 that is the same size as the fourth diameter D4. The second collar portion 350 forms a cylindrical shape having a predetermined length L and a sixth diameter D6 that is the same as the second diameter D2. The length L may be the same size as the radial span R of the first collar portion 340. That is, the length L and radial span R may both be an inch.

Figure 4:
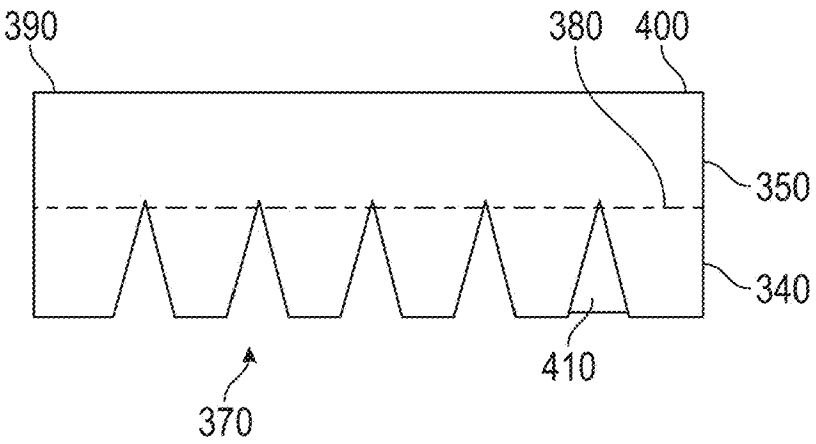
FIG. 4 shows weld tape that may be utilized to form the weld collar.

Turning to FIG. 4, in one embodiment, the collar 330 is formed by weld tape 370 that is partially folded about a center line 380 and rolled upon itself and its opposite ends 390, 400 are taped together to form the first and second collar portions 340, 350. Serrations 410 may be formed into the portion of the weld tape that forms the first collar portion 340 to prevent bunching of the tape material as the tape 370 is rolled upon itself.

In one embodiment, the first collar portion 340 is connected to the first runner 210 by a first RF (radio frequency) weld 370 (shown schematically). The second collar portion 350 is connected to the second runner 250 by a second RF weld 380 (shown schematically).

In sum, disclosed is an inflatable raft, having a base 110, a sidewall 130, front and back ends 150, 140, and first and second opposite sides 160, 170. A first tubular member 180 extends between the sides to define a first arch 220. A second tubular member 230 extends from the back end 140 to the first tubular member 180 at a weld joint 260 to define a second arch 260. At the weld joint 260 the first tubular member 180 has a first diameter D1. The second tubular member 230 has, end to end, a second diameter D2 that is smaller than the first diameter D1. Adjacent to the weld joint 260, the first tubular member 180 has a third diameter D3 that is the same as the second diameter D2.

In the above embodiments, the first tubular member 180 has an increased diameter relative to the second tubular member 230 at the weld joint 260. This reduces a curvature profile of the first tubular member 180 at the weld joint 260. Thus, when the raft 100 and tubular members 180, 230 are inflated, which occurs simultaneously, a failure at the weld joint 260 is eliminated.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

Those of skill in the art will appreciate that various example embodiments are shown and described herein, each having certain features in the particular embodiments, but the present disclosure is not thus limited. Rather, the present disclosure can be modified to incorporate any number of variations, alterations, substitutions, combinations, sub-combinations, or equivalent arrangements not heretofore described, but which are commensurate with the scope of the present disclosure. Additionally, while various embodiments of the present disclosure have been described, it is to be understood that aspects of the present disclosure may include only some of the described embodiments. Accordingly, the present disclosure is not to be seen as limited by the foregoing description, but is only limited by the scope of the appended claims.

What is claimed is:

1. An inflatable raft, comprising:

a base defining a base perimeter and a sidewall extending around the base perimeter, wherein the raft defines a front end, a back end, a first side and a second side that is opposite the first side;

a first tubular member extending between the first side and the second side, wherein the first tubular member has a first riser extending from the first side, a second riser extending from the second side and a first runner extending between the first riser and the second riser to define a first arch; and a second tubular member extending from the back end to the first tubular member, wherein the second tubular member has a third riser extending from the back end and a second runner extending to the first runner to define a second arch, wherein, the first runner and the second runner intersect each other at a weld joint, and at the weld joint, the first runner has a first diameter, and the second runner has a second diameter that is smaller than the first diameter, and wherein:

a first portion of the first runner extends from the weld joint toward the first riser and a second portion of the first runner extends from the weld joint toward the second riser; and adjacent to the weld joint, the first portion and the second portion of the first runner define a transition from the first diameter to a third diameter that is the same as the second diameter.

2. The raft of claim 1, wherein the weld joint is centered along the first runner.

3. The raft of claim 1, wherein the raft is fabricated of nylon.

4. The raft of claim 1, wherein, at the weld joint, the first runner and the second runner are perpendicular to each other.

5. The raft of claim 1, wherein the first diameter is at least 125% of a size of the second diameter.

6. The raft of claim 1, wherein the first diameter is 6.25 inches and the second diameter is 5 inches.

7. The raft of claim 1, wherein at the weld joint, the first runner defines an aperture for air to pass between the first runner and the second runner during inflation of the raft, wherein the aperture defines a fourth diameter that is smaller than the second diameter.

8. The raft of claim 7, wherein the second diameter between 150% and 300% of the fourth diameter.

9. The raft of claim 8, wherein the fourth diameter is between 2 and 3 inches.

10. The raft of claim 7, wherein:

at the weld joint, the second runner has an end edge that is against or adjacent to the first runner and conforms to a shape of the first runner;

a first surface region on the first runner, between the aperture and the end edge of the second runner, defines a first collar seat;

a second surface region within the second runner, extending away from the end edge of the second runner, defines a second collar seat; and the raft further includes:

a collar having a first collar portion that is welded to the first collar seat and a second collar portion that is welded to the second collar seat, to connect the first runner to the second runner.

11. The raft of claim 10, wherein the collar is formed of a same material as the first tubular member and the second tubular member.

12. The raft of claim 10, wherein the first collar portion defines a disk shape with a center aperture defining a fifth diameter that is the same as the fourth diameter.

13. The raft of claim 10, wherein the second collar portion defines a cylindrical shape having a predetermined length and a sixth diameter that is the same as the second diameter.

14. The raft of claim 10, wherein the first collar portion is connected to the first runner by a first RF weld and the second collar portion is connected to the second runner by a second RF weld.

15. An inflatable raft, comprising:

a base, a sidewall, front and back ends, first and second opposite sides;

a first tubular member extending between the sides to define a first arch; and a second tubular member extending from the back end to the first tubular member at a weld joint to define a second arch, at the weld joint the first tubular member has a first diameter, the second tubular member has, end to end, a second diameter that is smaller than the first diameter, and adjacent to the weld joint, the first tubular member has a third diameter that is the same as the second diameter.

* * * * *